US006079705A

United States Patent [19]

Skvoretz et al.

[11] Patent Number: 6,079,705

[45] Date of Patent: Jun. 27, 2000

[54] METHOD AND APPARATUS FOR VERIFYING THE INTEGRITY OF A MAIL PIECE

[75] Inventors: David M. Skvoretz, Northampton; Jack H. Shaneberger, Bath; James R. Moser, Easton, all of Pa.

[73] Assignee: Bell & Howell Mail and Messaging Technologies Co., Durham, N.C.

[21] Appl. No.: 09/072,599

[22] Filed: May 5, 1998

[51] Int. Cl.[7] ..... B41L 43/14

[52] U.S. Cl. ..... 270/32; 270/58.01; 235/375

[58] Field of Search ..... 235/375; 270/32, 270/58.01

[56] References Cited

U.S. PATENT DOCUMENTS 5,388,815 2/1995 Hill et al. ..... 270/32

*Primary Examiner*—Harold I. Pitts
*Attorney, Agent, or Firm*—Jenkins & Wilson, P.A.

[57] ABSTRACT

An apparatus and method for verifying the number of articles, preferably intended to be credit, debit, or similar cards, in a carrier is described. Though different embodiments are possible, the preferred embodiment comprises a caliper apparatus and microcontroller electrically linked to an inserter machine controller. The controller of the inserting machine is also electrically linked with an indicia reader mounted at the entrance to the inserter machine. The indicia read is found on the carrier and represents a machine readable representation of the number of articles that should be found in the carrier.

21 Claims, 8 Drawing Sheets

METHOD AND APPARATUS FOR VERIFYING THE INTEGRITY OF A MAIL PIECE

BACKGROUND OF THE INVENTION

In the field of credit and bank card (collectively referred to herein as "articles") distribution by mail, mail piece integrity is very important. Mail piece integrity means that the final sealed envelope contains exactly what it is supposed to. For various reasons, including mail room theft and envelope inserting machine or human error, mail piece integrity is not always achieved and the sealed envelope may not contain the correct number of articles. Therefore, methods for verifying the integrity of an article containing mail piece need to be continually developed.

Accordingly, there is room for improvement within the art.

OBJECTS OF THE INVENTION

It is an object of the invention to provide an easy method for assuring the integrity of an article containing mail piece.

It is a further object of the invention to provide an easy method for assuring the integrity of an article containing mail piece by comparing the number of articles which should be carried by a carrier document with the number of articles that are actually being carried by the carrier document.

It is a further object of the invention to provide an easy method for determining the integrity of an article containing mail piece that can be implemented using a variety of different electromechanical detection configurations.

These and other objects of the invention are achieved by a method for verifying the integrity of an article containing mail piece, comprising the steps of: providing a mail piece; determining the number of articles to be carried by the mail piece; verifying whether the number of articles to be carried by the mail piece equals the number of articles actually being carried by the mail piece; and declaring an error if the verification is negative.

These and other objects of the invention are achieved by a device for determining the integrity of an article carrying mail piece comprising: a thickness detecting station for detecting the thickness of the article containing mail piece; a microcontroller electronically connected to the thickness detecting station and for converting the detected thickness into a number of articles being carried by the article containing mail piece and comparing the number of articles with an expected number of articles.

DETAILED DESCRIPTION OF THE DRAWINGS

With reference to the above-mentioned figures, an apparatus and method for verifying the integrity of an article containing mailpiece according to the invention and that meets and achieves all the various objects of the invention will now be described. While the preferred embodiment of the apparatus comes in the form of a caliper apparatus, it should be understood that multiple variations are also foreseen and intended to be within the scope of the invention.

Figure 1A:
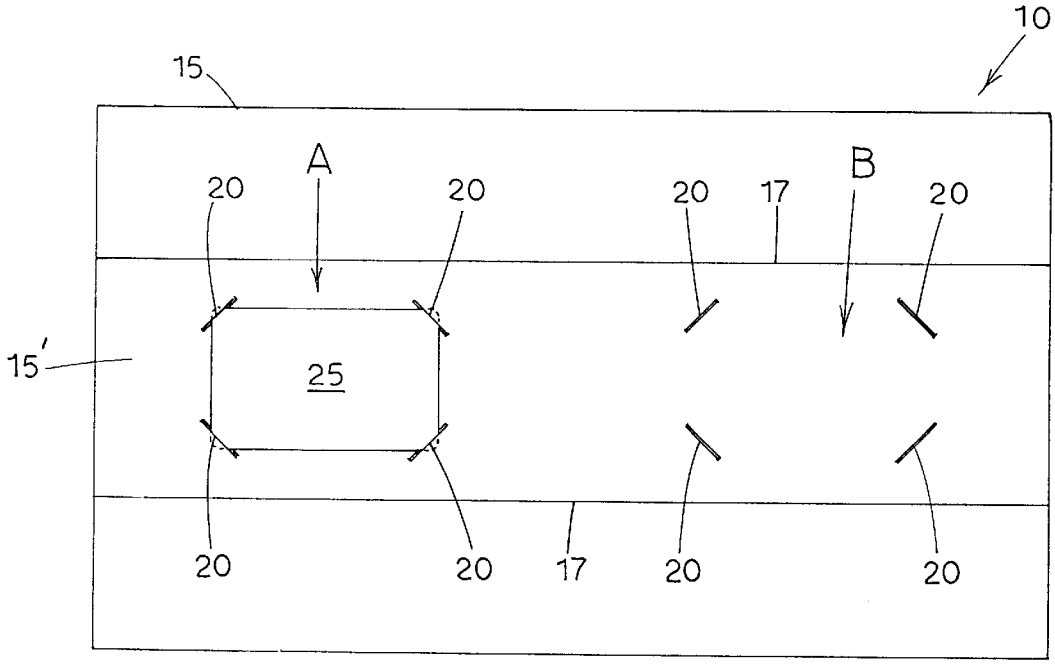
FIGS. 1A–1B are plan views of two different forms of a carrier document for carrying multiple articles.
Figure 1B:
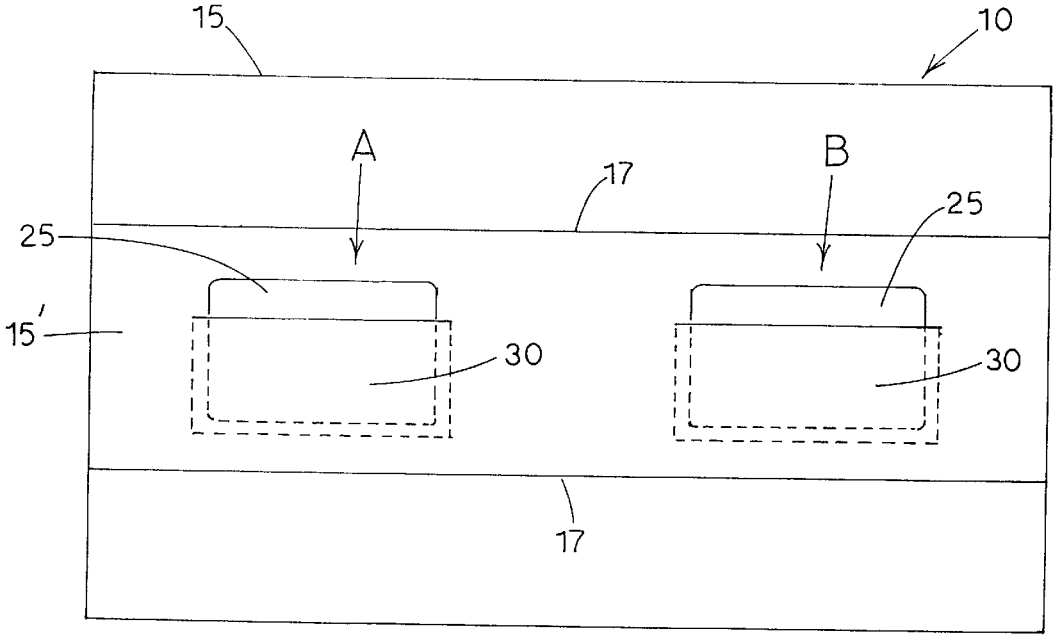

FIG. 1A is a plan view of a typical prior art carrier document/article combination 10. Carrier document 15 typically comprises a stiff-card stock with two folds 17 that allow carrier 15 to be z- or otherwise folded. Center panel 15' of carrier document 15 typically has slits 20 therein for receiving the corners of articles 25 at either or both of two article supporting locations A, B. In some applications, articles 25 may have glue on the back thereof (not shown) for bonding to center panel 15' of carrier document 15. Furthermore, in some applications, as shown in FIG. 1B, center panel 15' of carrier document 15 will have pockets 30 at article supporting locations A, B, for containing articles 25 therein.

In either of the configurations shown in FIGS. 1A, 1B, between 0–4 articles 25 can be carried by carrier 15 in the following configurations:

| Number of Articles | Location A | Location B |
|---|---|---|
| 0 | 0 | 0 |
| 1 | 1 or 0 | 0 or 1 |
| 2 | 1 or 2 or 0 | 1 or 0 or 2 |
| 3 | 1 or 2 | 2 or 1 |
| 4 | 2 | 2 |

Figure 2:
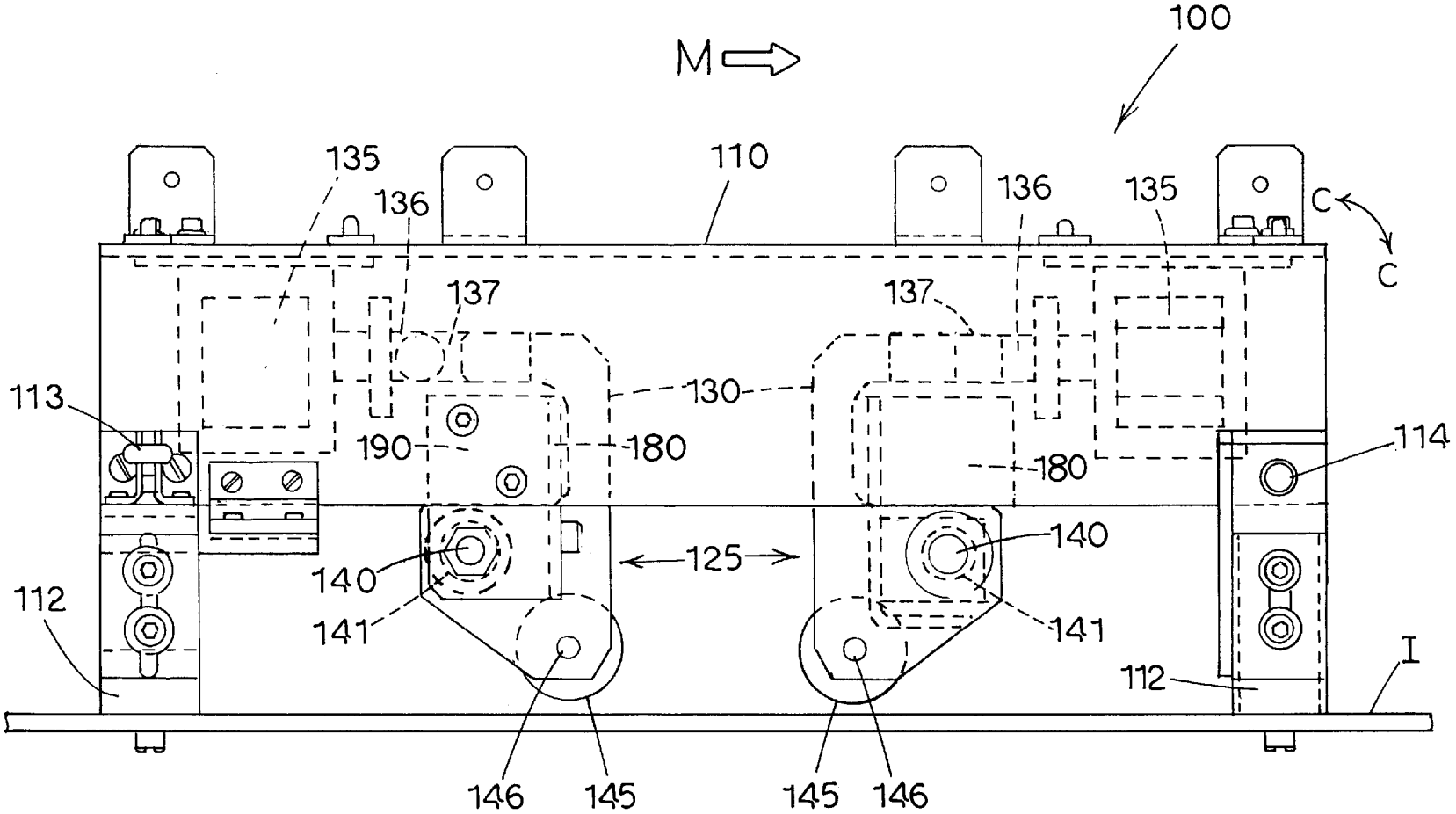
FIG. 2 is a cross-sectional elevation view of a preferred embodiment of a device for assuring the integrity of an article containing mailpiece according to the invention in the form of caliper apparatus.
Figure 3:
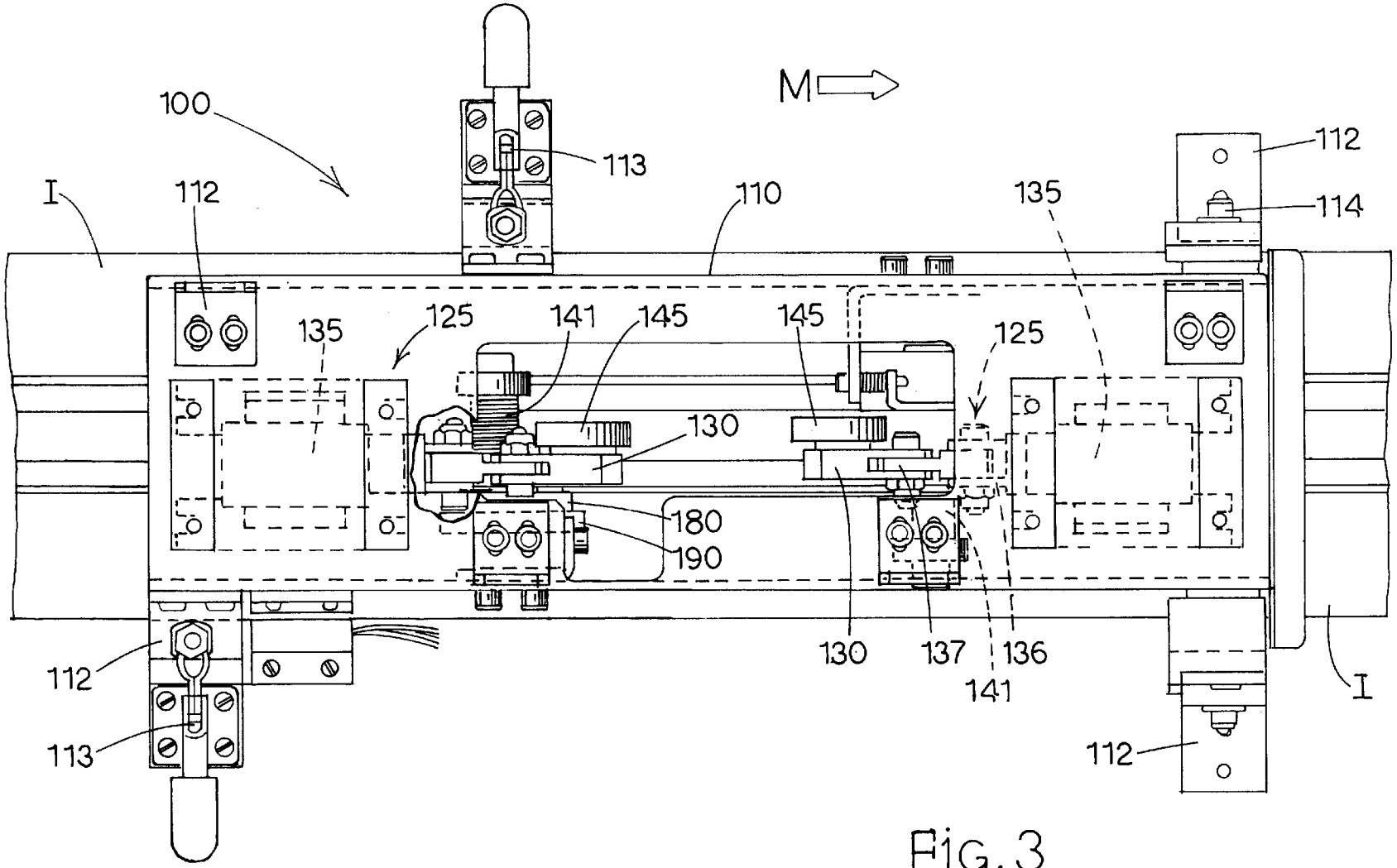
FIG. 3 is a cross-sectional top plan view of the preferred embodiment of a device for assuring the integrity of an article containing mailpiece according to the invention in the form of a caliper apparatus.

FIG. 2 is a cross-sectional elevation view of the preferred embodiment of an apparatus for assuring the integrity of an article containing mailpiece according to the invention and in the form of a caliper apparatus 100. Caliper apparatus 100 comprises housing 110 supported over and straddling the inserter raceway I of an envelope inserting machine (not shown) by legs 112. Housing 110 may be located at a position before or after the actual carrier inserting station, i.e., envelope stuffing station (not shown) as will be described below. Due to axle 114, the entire housing 110 is pivotable in the direction of arrow C—C to allow easy access to the underside of housing 110 and inserter raceway I. One or more locks 113, which may come in many conventional forms, prevents unwanted pivoting movement of caliper housing 110, which could cause errors in the operation of caliper apparatus 100.

As shown in FIG. 2, article/carrier combinations 10 pass through caliper apparatus 100 in the direction of arrow M on inserter raceway I.

Within caliper housing 110 are two moveable caliper assemblies 125. Two moveable caliper assemblies 125 are provided so that the thickness of an article carrier can be measured at the two distinct article supporting locations A, B, as shown in FIGS. 1A, 1B, where articles are typically located. However, if the carrier only has one article supporting location, it is possible to use only one caliper apparatus 100 or whatever type of thickness detector is being used.

Figure 5A:
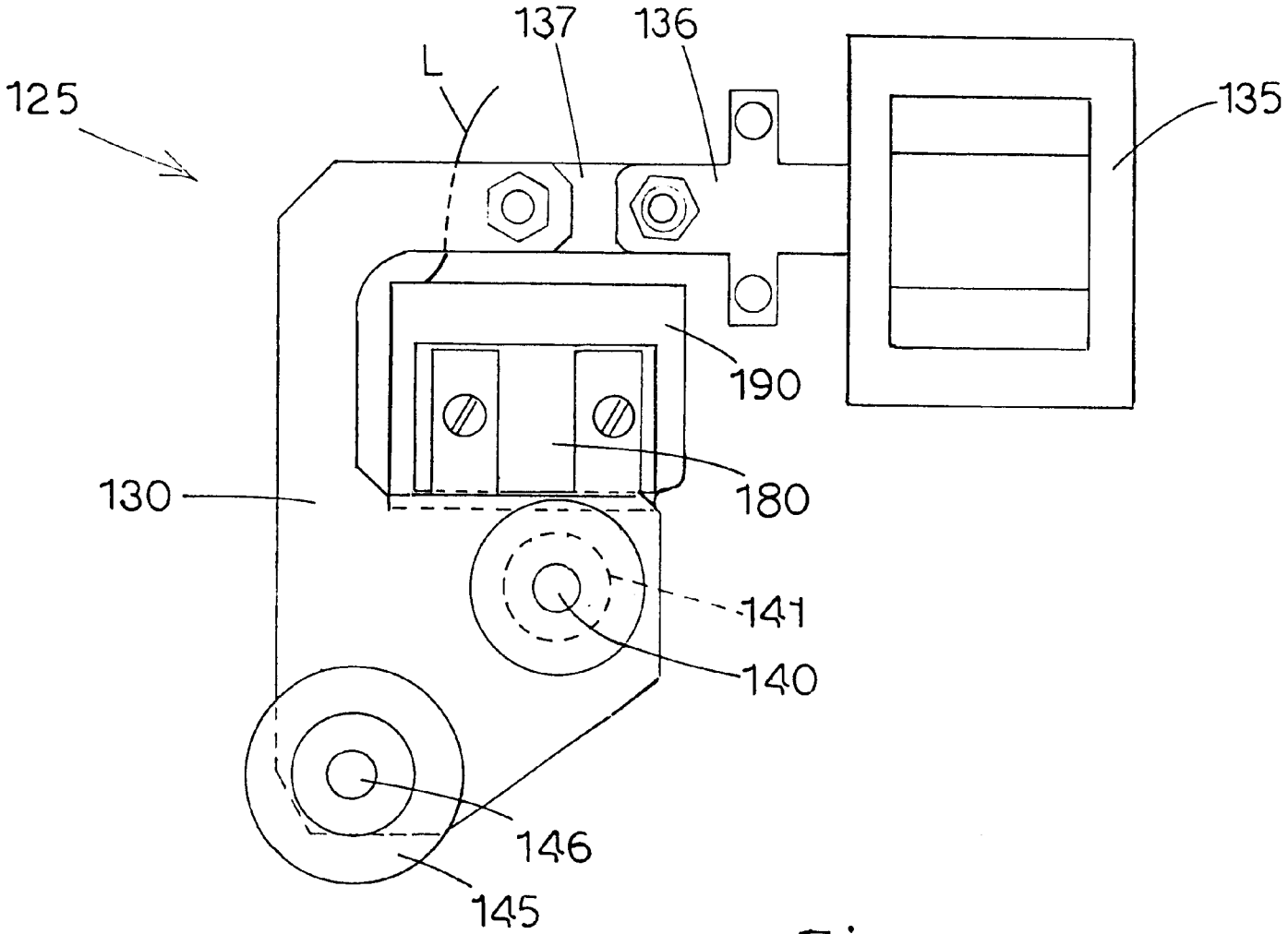
FIGS. 5A, 5B are enlarged elevation and plan views, respectively, of a detection portion of the preferred embodiment of a device for assuring the integrity of an article containing mailpiece according to the invention in the form of a caliper apparatus.
Figure 5B:
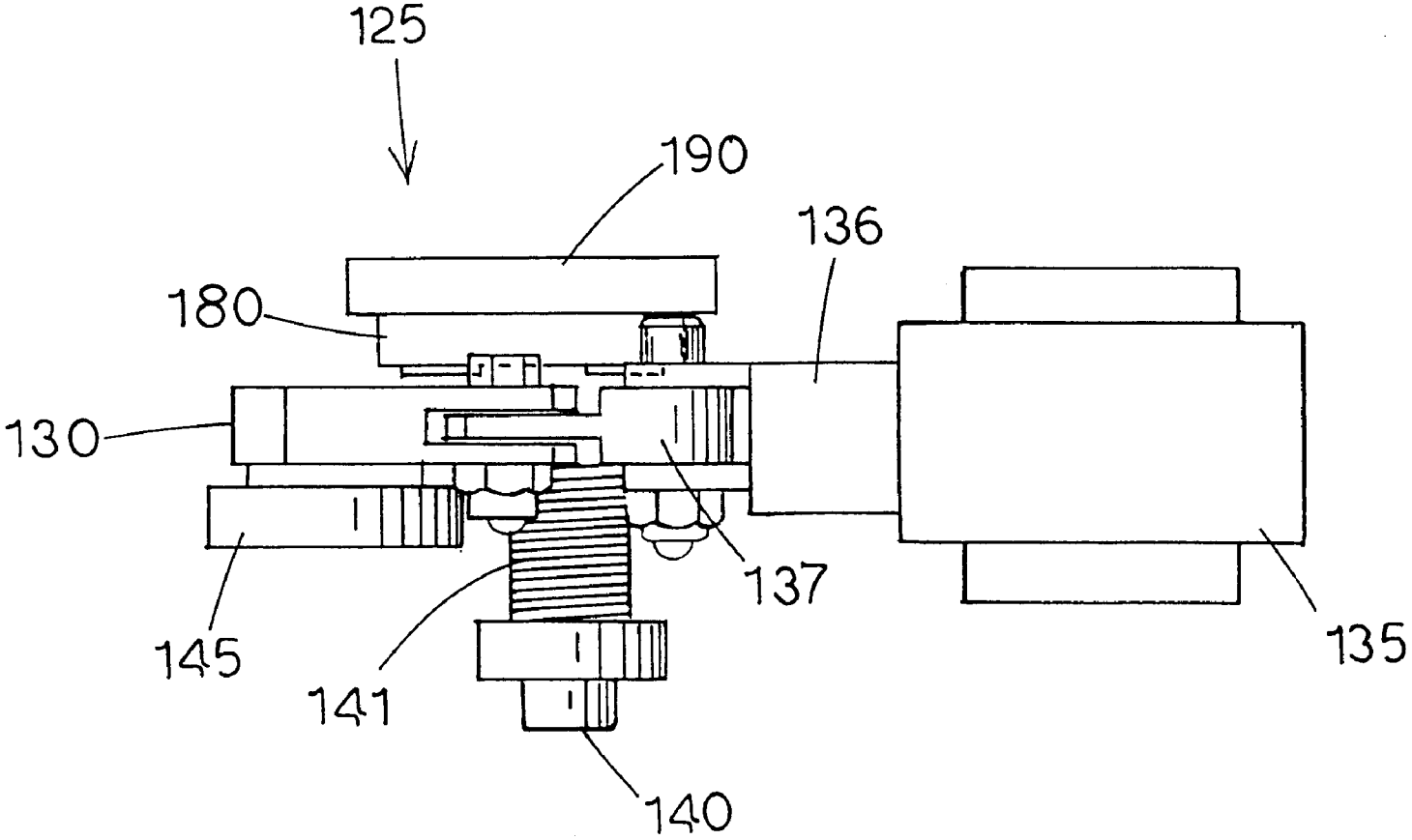

As most clearly shown in FIGS. 5A, 5B, each caliper assembly 125 comprises a caliper wheel 145 rotatably mounted to pivot arm 130 via axle 146. Pivot arms 130 are mounted within and to caliper housing 110 via another axle 140. Torsion springs 141 surround each axle 140 for biasing pivot arms 130 in a downward direction.

Magnets 180 are rigidly mounted to pivot arms 130 for movement therewith. Hall effect sensors 190 are stationarily mounted within and to caliper housing 110 and send an output voltage to a controller, as will be described below, via leads L. Normally energized solenoids 135 have their plungers 136 pulled in and bias pivot arms 130 and wheels 145 upward, away from the inserter raceway I (FIG. 2), via connecting linkage 137. When solenoid 135 is not energized, torsion springs 141 bias pivot arm 130 downward, moving magnet 180 relative to Hall effect sensor 190 and lowering caliper wheels 145 until they come into contact with the carrier document and rest thereon. The movement of magnet 180 relative to Hall effect sensor 190 results in a change in the output voltage of the Hall effect sensor 190. The output voltage is sent to controller C (FIGS. 4A, 4B) for comparison with values in a look-up table as will now be described.

Figure 4A:
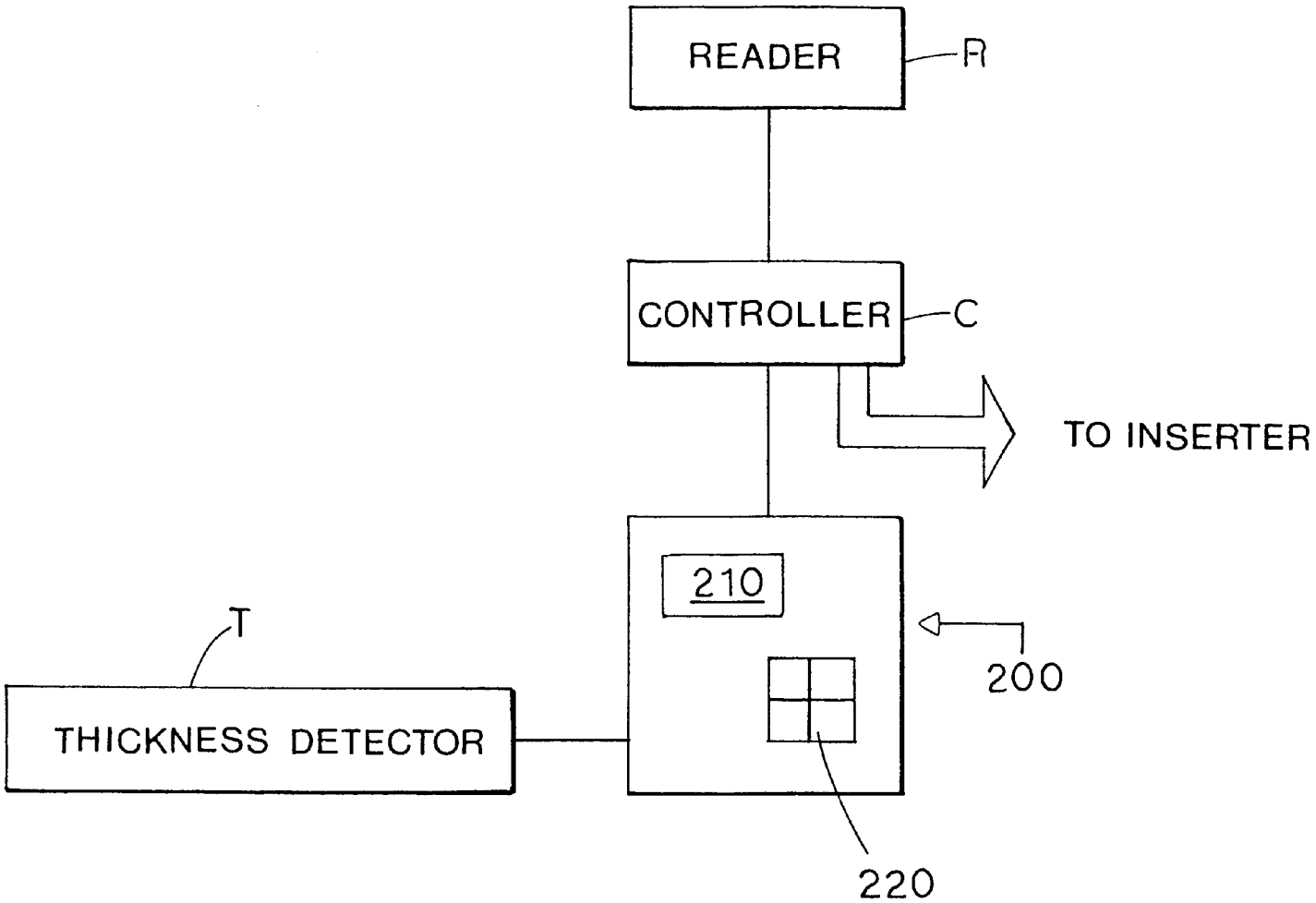
FIG. 4A is a simplified schematic representation of a generic embodiment of a device for assuring the integrity of a mailpiece according to the invention.
Figure 4B:
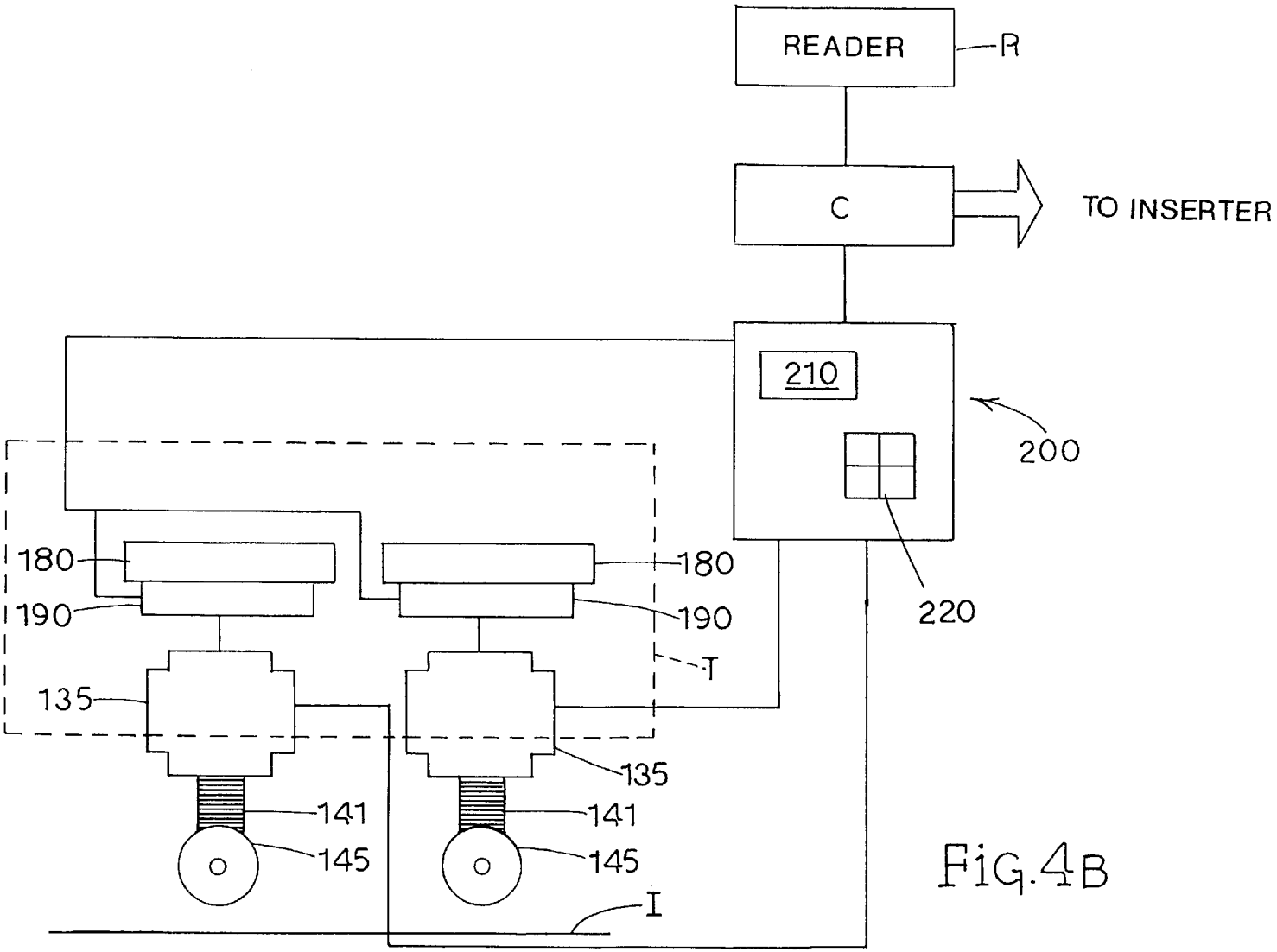
FIG. 4B is a simplified schematic representation of the preferred embodiment of a device for assuring the integrity of a mailpiece according to the invention in the form of a caliper apparatus.

FIG. 4A is a simplified schematic representation of a generic embodiment of a device for assuring the integrity of a mailpiece according to the invention. Thickness detector T, which may be in the preferred form of caliper apparatus 100, as shown in FIG. 4B, or other forms as will be described below, is controlled by microcontroller 200. In particular, as shown in FIG. 4B, solenoids 135 and Hall effect sensors 190 are electronically connected to microcontroller 200. Preferably, microcontroller 200 has a display screen 210 for displaying the number of articles determined to be in a carrier and control switches 220. Microcontroller 200 contains data arrays stored therein. The data stored in these arrays represent theoretical Hall effect sensor 190 output voltages to be caused by the relative movement of sensor 190 and magnet 180 and the number of articles at each of article supporting locations A, B, of a carrier needed to produce those theoretical output voltages. Microcontroller 200 is electronically connected to the control circuitry C of the inserter machine with which caliper apparatus 100 is being used. Finally, a reader module R, which may be in the form of: OMR (optical mark reader), BCR (bar code reader), or OCR (optical character recognition), is also electronically connected to the control circuitry C of the inserter machine (with which caliper apparatus 100 is being used) for telling control circuitry C how many total articles each carrier should be containing. To achieve this, the reader reads a machine readable indicia off of carrier 10 that represents how many articles 25 should be being carried by carrier 10 and sends a signal representative of that number to control circuitry C.

Having described the construction of the preferred embodiment of an apparatus for assuring the integrity of an article containing mailpiece according to the invention in the form of a caliper apparatus 100, its method of operation will now be described.

As described with respect to FIGS. 1A, 1B, carrier 10 can typically contain up to four articles 25. The thickness profile of folded carrier 10 depends upon the number of articles 25 contained at each of the article supporting locations A, B, therein. In particular, the various thickness profiles available are as set forth in the table below, wherein t=folded carrier document thickness, c=article thickness, and A, B, are the two article supporting locations.

| Thickness Profile of Carrier at Article Supporting Positions A, B | Number of Articles In Carrier |
|---|---|
| t, t | Zero |
| t + c, t | One |
| t + c, t + c | Two |
| t + 2c, t + c | Three |
| t + 2c, t + 2c | Four |

Accordingly, by determining the thickness of the carrier at the two article supporting locations A, B, caliper apparatus 100 will be able to accurately determine how many articles are actually being carried by the carrier. This actual number of articles will be compared against a predetermined number of articles that should be being carried by the carrier. When these two values match, the carrier is inserted into an envelope by the envelope stuffing station (not shown) to form a mailpiece, the mailpiece is sealed, and then sent downstream for further processing. However, if these two values do not match, an error is declared. At that point, the inserter machine can either be stopped or programmed to divert the erroneous carrier for operator error assessment.

The number of articles that should be carried by any particular carrier can be determined by the inserting machine in a number of different ways. In most instances, it is foreseen that machine readable indicia, such as OCR, BCR, or OMR, will be printed on each carrier. Using a conventional reader R suitable for the type of machine readable indicia selected, the indicia will be read off each carrier document and electronically sent to the inserting machine controller C prior to the carrier entering thickness detection station T.

After the machine readable indicia is read off the carrier, if caliper apparatus 100 is being used as the thickness detecting station, the inserter raceway conveyor then moves the carrier/article combination to a location within caliper apparatus 100 under caliper housing 110 and then stops. It is possible to use retractable front stops (not shown) to assure the proper positioning of the carrier within caliper apparatus 100 and under caliper housing 110. Caliper assemblies 125 will be in their upper, retracted positions due to the normal activation of solenoids 135. The inserting machine controller C will then send a signal to microcontroller 200. This signal tells microcontroller 200 to de-energize solenoids 135. The bias of springs 141 then takes over, thereby resulting in the downward movement of caliper assemblies 125 and caliper wheels 145 until they contact the top surface of the carrier document (if one is present) at the two different locations. Caliper assemblies 125 should be positioned such that when caliper wheels 145 are lowered they do not come into contact with the carrier document 15 in the area directly over where the embossed numbers, i.e., account numbers, would be. Rather, caliper wheels 145 are positioned such that they come into contact with the carrier document 15 directly over the flat areas of articles 25. This enhances the accuracy of caliper apparatus 100.

Figure 6A:
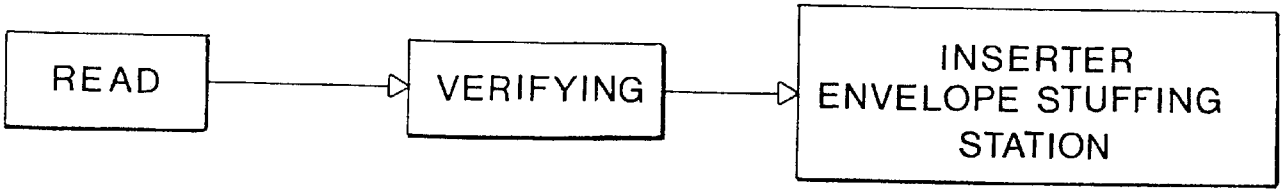
FIGS. 6A, 6B are simplified block diagrams showing the different orders in which the steps of the method according to the invention may be carried out.

The downward movement of caliper assemblies 125 and pivot arms 130 cause magnets 180 to move relative to Hall effect sensors 190. After a suitable delay period of about 100 ms (milliseconds), to allow the magnetic fields detected by the Hall effect sensors 190 to stabilize and caliper wheels 145 to settle, the new resulting output voltages of the two Hall effect sensors 190 are measured and sent to the microcontroller 200 via leads L. These output voltages are compared against the voltage data stored in the memory arrays contained within microcontroller 200. If the new resulting output voltages of the two Hall effect sensors 190 correspond to a stored voltage value indicative of 0, 1, or 2 articles, the number of articles at each article supporting location A, B, is determined and added together and the sum is displayed on screen 210. An electrical signal representing this sum is then sent to inserter controller C and compared to the expected number of articles as read off the carrier document 15 by reader R, as described above. If the two values match, the carrier is inserted into an envelope at the envelope stuffing station (not shown), the envelope sealed, and sent off to mailing. If the two values do not match, an error is declared, and the appropriate action taken. Such appropriate action may include triggering an alarm and/or diverting the erroneous carrier out of the inserter machine for operator examination. This method of operation is shown in the block diagram of FIG. 6A.

Note that, it is also possible for caliper assemblies 125 to merely detect whether a carrier document 10 is present. This can be achieved by providing the microcontroller memory arrays with stored data corresponding to a Hall effect sensor output voltage that would result if wheels 145 settled to a point lower than where the top surface of an empty carrier document would lie, i.e., below a height of t. Accordingly, should this voltage be detected by microcontroller 200, a no carrier error would be declared.

Figure 6B:
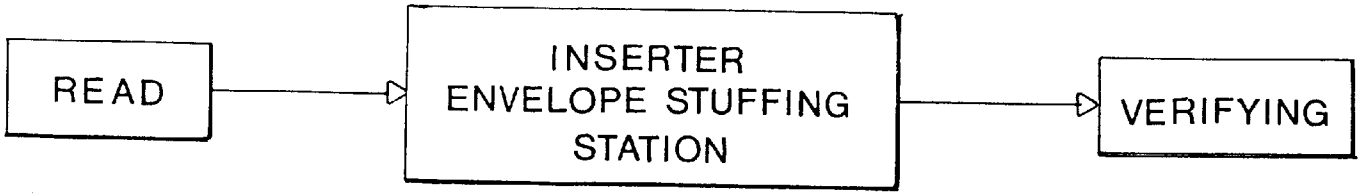

An alternative method for operating the invention is shown in FIG. 6B and comprises doing the thickness check after the carrier is inserted into an envelope by the envelope stuffing station (not shown). In this method, microcontroller 200 would calculate the expected thickness of the entire mail piece (carrier and envelope). Such a calculation first involves the machine operator entering values for envelope thickness (e), carrier thickness (t), and individual article thickness (c). Microcontroller 200 then performs the following calculation for each of the two carrier locations (wherein p=expected number of articles to be located at each carrier location as determined by reading the optical marks off the carrier):

$$\text{expected mail piece thickness}=e+t+c*p.$$

Using a look-up table and memory arrays, expected sensor output voltages are determined. Then, for example, using a caliper apparatus 100 positioned after the envelope stuffing station (not shown), calipers 125 are used to determine the thickness of the mail piece at the two article supporting locations A, B. These thicknesses result in particular actual Hall-effect sensor output voltages. The actual voltages are compared against the expected voltages. If the voltages match, the mail piece is declared 'OK' and fed to a downstream operation. If the voltages do not match, once again, an error is declared and then one of the various actions described above is taken.

While the preferred embodiment of the apparatus for verifying the integrity of an article containing mailpiece according to the invention has been described in the form of a caliper apparatus, that is not the only apparatus contemplated for carrying out the method. There are many other structures which can be used for thickness detection station T yet still meet and achieve the various objects of the invention. For example, it may be possible to implement such thickness detectors as: a very powerful through-beam laser or infrared emitter and detector which looks through the article carrying document to detect the presence or absence of articles; an ultrasonic detector and emitter; or even mechanical limit switches.

The above description is given with reference to a method and apparatus for verifying the integrity of an article containing mailpiece. However, it will be understood that various details of the invention may be changed without departing from the scope of the invention. Furthermore, the foregoing description is for purpose of illustration only, and not for purpose of limitation, as the invention is defined by the following, appended claims.

That which is claimed:

1. A method for verifying the integrity of an article containing mail piece, comprising the steps of:

providing a mail piece;

determining the number of articles to be carried by said mail piece;

verifying whether the number of articles to be carried by said mail piece equals the number of articles actually being carried by said mail piece; and declaring an error if said verification is negative.

2. The method according to claim 1, wherein said step of determining the number of articles to be carried by said carrier comprises the step of reading indicia off a carrier document.

3. The method according to claim 2, wherein said step of verifying the actual number of articles in said carrier comprises the step of using a caliper apparatus to determine the thickness of said mail piece.

4. The method according to claim 3, wherein said step of using a caliper apparatus further comprises determining the thickness of said mail piece at two different locations on the mail piece using two independent caliper apparatuses.

5. The method according to claim 4, wherein said step of determining occurs during the conveying of the article containing mail piece to an inserting machine and prior to the caliper apparatuses.

6. The method according to claim 3, wherein said mail piece comprises a carrier document.

7. The method according to claim 6, wherein said step of verifying occurs prior to an envelope stuffing station.

8. The method according to claim 3, wherein said mail piece comprises an envelope/carrier combination.

9. The method of claim 8, wherein said step of verifying further comprises:

determining the expected thickness of said envelope/carrier combination; and comparing said expected thickness with said determined thickness.

10. The method according to claim 9, wherein said step of determining the thickness of the envelope/carrier combination comprises: adding together the thicknesses of said carrier, said envelope, and the expected number of articles to be carried by said carrier.

11. A device for verifying the integrity of a mail piece comprising:

a caliper housing positioned over a raceway of an inserting machine;

a first caliper apparatus contained within said housing;

a first solenoid for raising and lowering said first caliper apparatus above said raceway;

a first magnet and Hall effect sensor for producing a first output voltage indicative of how far said first caliper apparatus is raised or lowered;

a microcontroller for controlling said first solenoid and comparing said first output voltage with an expected output voltage.

12. The device of claim 11, further comprising:

a reader for reading indicia off said mail piece; and a second controller, said second controller using said read indicia to determine said expected output voltage.

13. The device of claim 12, wherein said mail piece comprises a carrier document and said caliper apparatus is located to prior to an envelope stuffing station.

14. The apparatus of claim 12, wherein said mail piece comprises an envelope/carrier document combination and said caliper apparatus is located after an envelope stuffing station.

15. The apparatus of claim 11, further comprising:

a second caliper apparatus contained within said housing;

a second solenoid for raising and lowering said second caliper apparatus above said raceway;

a second magnet and Hall effect sensor for producing a second output voltage indicative of how far said second caliper apparatus is raised or lowered;

said microcontroller controlling said first and second solenoids and using said first and second output voltages to determine the number of articles being carried by said mail piece.

16. A device for determining the integrity of an article carrying mail piece comprising:

a thickness detecting station for detecting the thickness of said article containing mail piece;

a microcontroller electronically connected to said thickness detecting station and for converting said detected thickness into a number of articles being carried by said article containing mail piece and comparing said number of articles with an expected number of articles.

17. The device according to claim 16, wherein:

said thickness detecting station detects the thickness of said mail piece at two different locations.

18. The device according to claim 17, wherein said thickness detecting station comprises two independent caliper apparatuses.

19. A method for verifying the integrity of an article containing mail piece, comprising the steps of:

providing a mail piece;

determining the number of articles to be carried by said mail piece;

verifying whether the number of articles to be carried by said mail piece equals the number of articles actually being carried by said mail piece, said step of verifying including the step of determining the thickness of said mail piece; and declaring an error if said verification is negative.

20. A method for verifying the integrity of an article containing mail piece, comprising the steps of:

providing a mail piece;

determining the number of articles to be carried by said mail piece;

verifying whether the number of articles to be carried by said mail piece equals the number of articles actually being carried by said mail piece by using a caliper apparatus to determine the thickness of said mail piece; and declaring an error if said verification is negative.

21. A method for verifying the integrity of an article containing mail piece, comprising the steps of:

providing a mail piece including an envelope/carrier combination;

determining the number of articles to be carried by said mail piece;

verifying whether the number of articles to be carried by said mail piece equals the number of articles actually being carried by said mail piece by using a caliper apparatus to determine the thickness of said mail piece; and declaring an error if said verification is negative.

* * * * *